United States Patent [19]

Bogucki-Land

[11] Patent Number: 5,012,563

[45] Date of Patent: May 7, 1991

[54] STRETCHING ARRANGEMENT FOR STRETCHING OF PLASTIC THREADS

[75] Inventor: Bodgan Bogucki-Land, Offenbach, Fed. Rep. of Germany

[73] Assignee: Karl Mayer Textilmaschinenfabrik GmbH, Obertshausen, Fed. Rep. of Germany

[21] Appl. No.: 496,785

[22] Filed: Mar. 21, 1990

[30] Foreign Application Priority Data

Mar. 22, 1989 [DE] Fed. Rep. of Germany ..... 3909348

[51] Int. Cl.[5] ..... D02J 1/22; D03H 3/00

[52] U.S. Cl. ..... 28/172.1; 28/185; 28/186; 28/187; 57/346

[58] Field of Search ..... 28/172 R, 185–187, 28/241, 242, 246; 57/332, 344–346; 34/41, 49; 219/388 S; 264/290.5; 200/61.17, 61.18; 242/36, 37 R

[56] References Cited

U.S. PATENT DOCUMENTS

| | | | |
|---|---|---|---|
| 3,602,966 | 9/1971 | Fleissner | 28/246 X |
| 3,855,778 | 12/1974 | Brandi et al. | 57/346 X |
| 4,010,915 | 3/1977 | Strutz et al. | 28/186 X |
| 4,669,159 | 6/1987 | Bogucki-Land | 28/185 |
| 4,852,225 | 9/1989 | Hagewood et al. | 28/187 |
| 4,868,959 | 9/1989 | Bauer at al. | 28/187 |

FOREIGN PATENT DOCUMENTS

| | | | |
|---|---|---|---|
| 903968 | 7/1972 | Canada | 28/246 |
| 1134575 | 11/1982 | Canada | 28/242 |
| 0150301 | 8/1985 | European Pat. Off. . | |

*Primary Examiner*—W. C. Reynolds
*Assistant Examiner*—John J. Calvert
*Attorney, Agent, or Firm*—Omri M. Behr

[57] ABSTRACT

An arrangement for the stretching and warping of synthetic warp threads under the influence of heat. The arrangement has feed rollers for driving warp threads, take off rollers for driving warp threads received from the feed rollers, with the take off rollers having a higher circumferential speed than the feed rollers. Additionally there are at least two rotatable deflection rollers, of which at least one roller is heatable with the rollers being rotatable in directions opposite to each other, and at least two auxiliary rollers which are rotatable in directions opposite to each other. A feed segment of the thread extends from the feed roller arrangement to the deflection roller proximate thereto and a take off segment of the threads extends from the deflection roller proximate thereto, to the take off roller arrangement. One of the auxiliary rollers is moveable against the side of the threads on the feed section contactable by the deflection roller proximate to the feed rollers and another auxiliary roller is moveable against the side of the thread of the takeoff segment contactable by the deflection roller proximate to the take off rollers. The threads are liftable from the deflection rollers.

15 Claims, 2 Drawing Sheets

STRETCHING ARRANGEMENT FOR STRETCHING OF PLASTIC THREADS

FIELD OF THE INVENTION

Wear stretching of synthetic polymeric threads.

BACKGROUND OF THE INVENTION

The invention is directed to a stretching arrangement for the stretching of plastic threads, in particular synthetic polymeric threads, under the provision of heating, utilizing a feed roller arrangement, a take off roller arrangement which runs at a higher speed than the feed roller arrangement, two heated rotatable deviation rollers of which at least one is heated and whose axes which are displaceable with respect to each other, wherein the feed section of the thread extends from the feed roller arrangement to one of the deviation rollers and the take off section of the thread from the other deviation roller to the take off roller arrangement and two auxiliary rollers whose axes which are also displaceable in opposing directions, with respect to each other.

In a known stretching arrangement of this type (EP 143 466A and EP 150 301A), the deviation roller pair is mounted on a frame which is rotatable about a pivot point midway between the rollers and can thus be moved out of contact with the thread sheet. In order to take up the slack which results from the separation of the deviation rollers from the sheet thread, there is provided a pair of auxiliary rollers which are geometrically constructed in a similar manner to the deviation rollers. The pivot points of both roller pairs lie in the common plane between the feed and take off rollers. When the stretching arrangement is halted, for example, by reason of thread break, the deviation rollers are swung out of contact with the thread sheet in order to prevent the overheating of the threads, which would have the consequence of crystallization which, in turn, could lead to further breaks. In this procedure, when the hot deviation rollers are swung out of contact with the thread sheet, uncontrolled thread consumption and deformation can result. Regrettably, crystallization can already have occurred if the threads lie on the heated deviation rollers for more than 2 or 3 seconds. This period of time can be readily exceeded if the swing-out of the rollers occurs too slowly. On the other hand, if the rollers are moved too quickly, the resulting increased forces raise the possibility of excessive mechanical stretching. A further disadvantage of this arrangement lies in the very substantial space requirement of the construction. Furthermore, it is necessary to provide a very exact control of the movement of the roller pairs in relation to each other during the step of activation of the auxiliary rollers and deactivation of the deviation rollers so that on the one hand, excessive tension of the rollers is avoided and on the other hand, extensive slack is also avoided.

Another approach to this problem is disclosed in U.S. Pat. No. 4,669,159 of the present applicant. This arrangement utilizes a single, radially divided deviation roller. One half of the roller is heated and the other half is not heated or even cooled. In operation of the device, the threads slide over the heated portion. Upon stoppage of the arrangement, the cooled half is immediately brought into contact with the threads. The disadvantage of this system is that in the normal operation of the device, a relatively long friction path is required for the yet unstretched threads which, in some cases, is undesirable.

SUMMARY OF THE INVENTION

It is an object of this invention to provide a stretching arrangement of the foregoing type which reduces the stress on the threads in the at-rest position. The problem is solved therein that there is provided an auxiliary roller which is moveable into contact with the side of the feed segment at the thread facing the first deviation roller and similarly another with the side of the take-off segment of the thread facing the second deviation roller, wherein the threads are liftable off the deviation rollers.

By means of this invention, it is possible to avoid or substantially reduce the sliding of the threads on the deviation rollers. Since the friction between the threads and rollers can be substantially eliminated, no undesired stretching due to uncontrolled tensions can occur. Furthermore, it is possible to avoid the undesired contact of the heated deviation rollers with the thread sheet. The threads are basically peeled off the deviation rollers by means of the auxiliary rollers. The term "movement of the axes of the rollers of the pair in opposite directions" means the movement which, in a Cartesian coordinate system, there is present at least one component operating in the opposite direction. The solution provided by the invention substantially ensures that the deviation rollers come into fairly accurate contact with the thread sheet segment with which they are in contact before the "switch-out" step. This avoids the occurrence of error points due either to under-or overheating. Furthermore, the stretching arrangement accordance with the present invention utilizes substantially less floor space than the arrangement of the prior art. This saving of space is particularly important in "on line" where a plurality of machines is utilized for the preparation of a row of warp beams.

In a preferred embodiment the movement paths of the deviation rollers and the auxiliary rollers run in a symmetrical manner about axes which lie between the said rollers and to parallel their axes, which are substantially identical for the movement path of deviation rollers and the movement path of the auxiliary rollers. This enables the movement paths to be contained in a rather restricted space. The size of construction is thus further reduced. Furthermore, the mode of construction can be simplified which means that the movement of the pairs of rollers can be efficiently controlled.

It is particularly advantageous to provide that the movement of the deviation rollers and/or the auxiliary rollers run on concentric circular paths. This can, for example, be achieved in that the deviation rollers are provided on swingable pairs of levers which have a common swinging or pivot point. The movement path of the roller pairs and the corresponding change of the path of the thread sheet can thus be readily calculated and optimized.

A simple mode of effecting the circular path may be achieved by mounting the deviation rollers in a deviation roller ring, which is oriented within a ring for the auxiliary rollers having the same mid-point.

It is further advantageous to provide both the deviation roller ring and the auxiliary roller ring with a single drive means. Both rings are driveable in opposite directions. When the auxiliary rollers are activated, the resultant force direction on the deviation rollers is altered by altering the direction of the thread feed and take off so that the deviation rollers are already of themselves, swung out of contact with the thread sheet. An even better control of the movement can however be obtained when the mounting rings are actually driven by the deviation rollers and the auxiliary rollers. The opposed movement of the mounting rings, that is to say, their mutually opposed rotation direction, ensures that the threads are taken up by the auxiliary rollers as soon as they are surrendered by the deviation rollers. In the most preferred embodiment, at least one of the drives is provided as a pneumatic or hydraulic piston-cylinder unit. Since the mounting rings need only rotate to and fro through a predetermined turning angle, it is sufficient to utilize a drive means which can move a given point on a predetermined path. Pneumatic and hydraulic piston-cylinder arrangements have the further advantage that they are easily controlled both with respect to the movement as well as with respect to the forces which must be applied during such movement.

It is advantageous to arrange that the maximum drive force of the auxiliary ring is set less than the corresponding value of the stretching force of the threads. Thus, the auxiliary rollers can readily be moved into the path of the thread sheet without the danger of overstraining through exceeding the preset stretching force. Since the maximum force is less than the stretching force, the auxiliary rollers can only be moved further when the deviation rollers, by their own movement resulting from a change in direction of the forces, have surrendered the corresponding part of the thread sheet. That is to say, that the thread sheet, in this area, has become "looser".

In a preferred embodiment, the pressure in the appropriate piston cylinder arrangement is controllable over the movement path of the piston. This ensures that not only is the maximum force limited, but it is also possible to control the amount of force applied over the movement path of the auxiliary rollers.

The invention with respect to its preferred embodiments which are illustrated in the drawings, may be summarized as follows:

DETAILED DESCRIPTION OF THE INVENTION

Figure 1:
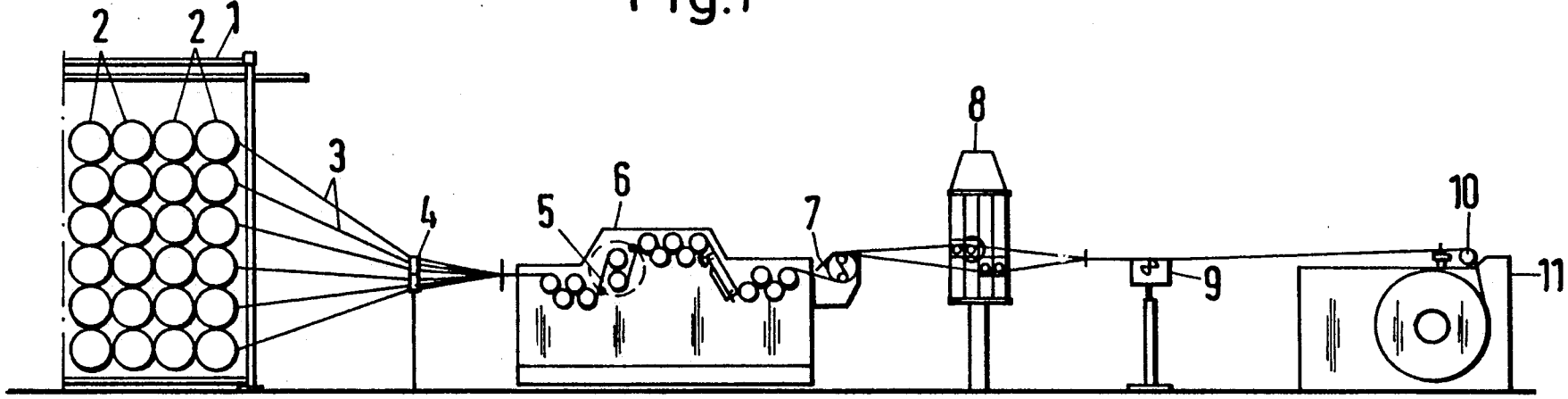
FIG. 1 is a schematic elevational view of the arrangement of the present invention oriented between the creel and the take-up beam.
Figure 2:
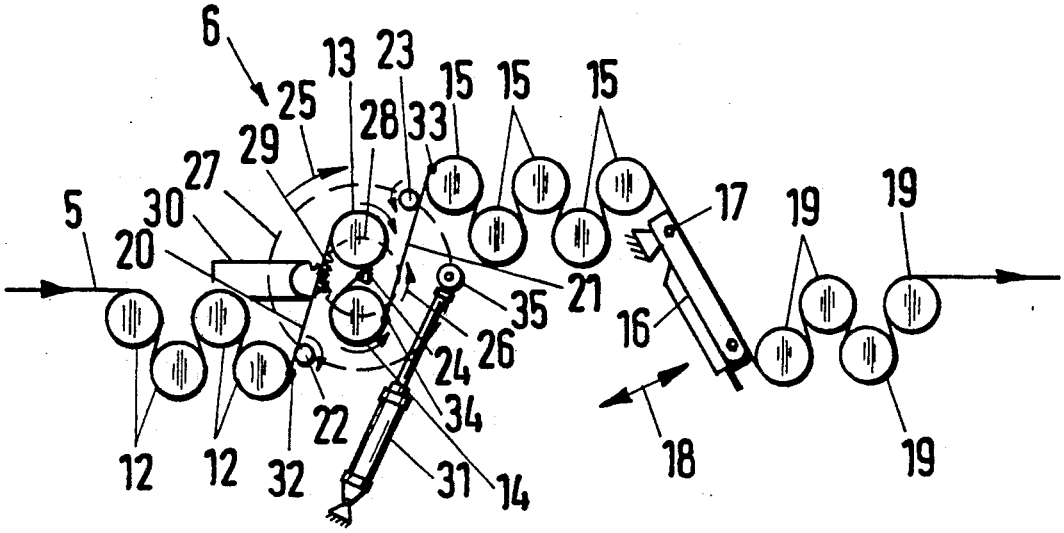
FIG. 2 is a schematic elevational view of the stretching portion of the arrangement in the stretching orientation.

In the creel 1 there are mounted a predetermined number of spools 2 from which individual threads 3 are led through eyelets 4 to thread sheet 5 which is stretched in a stretching arrangement 6 by the application of heat. At the exit of the stretching arrangement 6 there is provided a thread tensioning counter-poise 7. The thread sheet 5 then runs through a tangling arrangement 8 and an oiling apparatus 9 before running over turning roller 10 in a warping machine 11 and are there wound on a beam.

The thread sheet 5 in stretching arrangement 6 runs over feed roller arrangement 12 a pair of heated deviation rollers 13 and 14 and a takeoff roller arrangement 151, which is driven at a greater speed than the feed roller arrangement 12. Thus, the threads are tensioned between the contact point 32 on the feed roller arrangement 12 and contact point 33 on take off roller arrangement 15 which is sufficient to cause its stretching. The thread sheet 5 is warmed in the heated deviation rollers 13 and 14 and then stretched between stretching point 34 on deviation roller 14 and contact point 33 on take-up roller arrangement 15. Downstream of the take-up roller arrangement 15 the thread sheet 5 runs over a relaxation plate 16 which is swingable in the direction of the double arrow 18 about an axis 17. After the relaxation plate 16, the thread sheet 5 runs over an exit roller arrangement 19 where it leaves the stretching arrangement 6.

Between the feed roller arrangement 12 and the first deviation roller 13, the thread sheet 5 forms a feed segment 20. Between the other deviation roller 14 and the take off roller arrangement 15 the thread sheet 5 forms a take off segment 21. An auxiliary roller 22 is moveable in feed segment 20, against the side of the thread sheet 5 with which it lies on deviation roller 13. In a similar manner, auxiliary roller 20 is moveable, in the area of take off segment 21, against the side of thread sheet 5 which lies against the deviation roller 14.

The movement of auxiliary rollers 22 and 23 follows the direction of arrow 25 in a circular path 27 about midpoint 24. In the illustrated example, both auxiliary rollers 22 and 23 are mounted on a circular ring, which is moveable by means of a pneumatic piston-cylinder arrangement 31, which is fixed either on the floor or on the arrangement itself and attached to a pivot point 35 on the circular ring. The deviation rollers 13 and 14 are mounted on a circular ring 28 which is moveable in direction 26 by means of a motor 30. The motor 30 drives a toothed wheel which interacts with the rim gear 29 affixed to circular ring 28.

Figure 3:
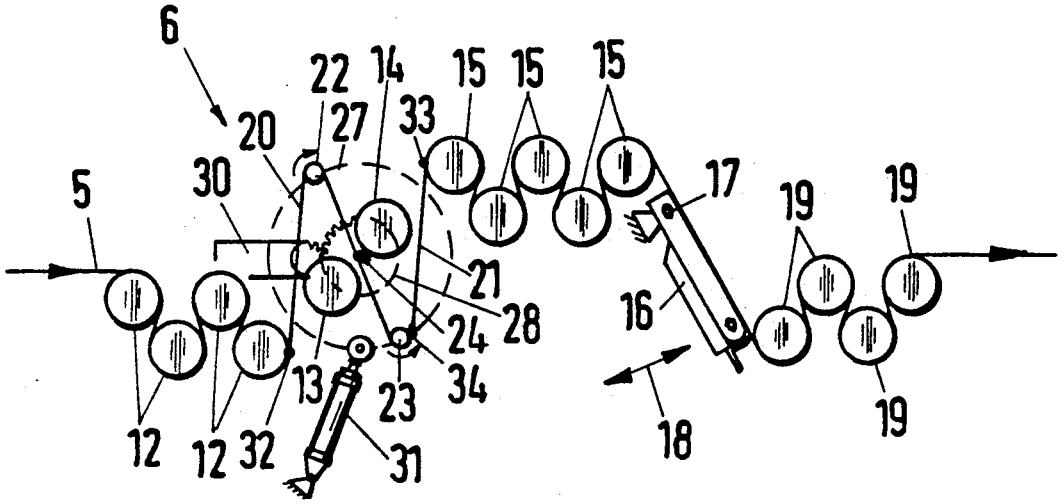
FIG. 3 is a view of the arrangement of FIG. 2 in the "at-rest" orientation.

During the operation of the device it may be necessary to interrupt the flow of thread sheet 5 for example, because of thread breakage. In this case, the auxiliary rollers 22 and 23, running upon their circular path, are moved by the action of pneumatic drive 31 against feed segment 20 and take off segment 21. This alters the force which the thread sheet 5 exercises upon the deviation rollers 13 and 14. The deviation rollers move themselves in the direction of arrow 26 about the common midpoint 24. Since, in addition thereto, the deviation roller ring 28 is driven by motor 30, the deviation rollers 13 and 14 rotate in a direction opposite to that of the auxiliary rollers 22 and 23 so that in a very brief time the thread sheet path illustrated in FIG. 3 is achieved.

The thread sheet 5 is thus peeled from the deviation rollers by means of the auxiliary rollers 22 and 23. While the lifting movement of the thread sheet from the deviation rollers 13 and 14 takes place, there is no relative movement between the said rollers and the thread sheet 5. This relative movement is also not present during the return movement of the auxiliary rollers that is to say, when the thread sheet 5 is again laid on the deviation rollers 13 and 14. It is thus easy to see that the deviation rollers 13 and 14, would recontact the thread sheet 5 at substantially the same point as they contacted, just before contact was broken. This simple arrangement insures that thread segments are either not heated or over heated.

The pneumatic piston cylinder arrangement 31 is so provided that the maximum force which it can deliver may be set at a value less than the stretching tension of the thread sheet. When the auxiliary rollers 22 and 23 are moved against the thread sheet they can only move further along their predetermined path when the deviation rollers 13 and 14 release the tension, that is to say, free up part of the thread sheet. Without such a force limitation, the auxiliary rollers could apply an unacceptable degree of force upon the thread sheet, that is to say, bring about an undesired level of stretching. It is possible that to refine the control of the pneumatic piston cylinder to such an extent that a constant force may be applied over the entire movement path of the auxiliary rollers 22 and 23. In order to achieve this end it is necessary to alter the pressure in the piston cylinder arrangement over the movement path since, because of the changing projected lever path length the turning moment delivered by the pneumatic drive 31 alters.

The invention is not to be considered as limited to the circular movement path illustrated. Any other movement path may be utilized in which the auxiliary rollers and the deflection rollers are displace in mutually opposite directions wherein, by appropriate control of the movement mechanism which ensures that the maximum permitted thread tension is not exceeded and that after the decontacting of the deviation rollers no slack appears in the thread sheet 5.

I claim:

1. Arrangement for the stretching and warping of synthetic warp threads under the influence of heat comprising:

a feed roller means for driving said warp threads, a take off roller means for driving said warp threads received from said feed roller means, said take off roller means having a higher circumferential speed than the said feed roller means, at least two deflection rollers rotatable about their longitudinal axes, of which at least one roller is heatable, means coupled to said heatable roller for providing heat thereto, at least two auxiliary rollers rotatable about their longitudinal axes wherein a feed segment of the thread extends from the feed roller means the deflection roller proximate thereto and a take off segment of the threads extends from the deflection roller proximate thereto, to the take off roller means, wherein one of said auxiliary rollers is moveable against the side of the threads on the feed section contactable by the deflection roller proximate to the feed rollers and another auxiliary roller is moveable against the side of the thread of the take-off segment contactable by the deflection roller proximate to the take off rollers whereby the threads are liftable from the deflection rollers.

2. Stretching arrangement in accordance with claim 1, wherein said deflection rollers have mutually opposed directions of rotation about their longitudinal axes.

3. Stretching arrangement in accordance with claim 1, wherein said auxiliary rollers have mutually opposed directions of rotation about their longitudinal axes.

4. Stretching arrangement in accordance with claim 1, wherein the longitudinal axes of said deflection rollers are discplaceable in mutually opposed directions motion.

5. Stretching arrangement in accordance with claim 1, wherein the longitudinal axes of said auxiliary rollers are discplaceable in mutually opposed directions motion.

6. Stretching arrangement in accordance with claim 1, wherein movement paths of the axes of rotation of the deflection rollers and of the auxiliary rollers are radially symmetrical about a substantially central axis located between all of said rollers and lying parallel to the several individual axes thereof, said substantially central axes being substantially identical for the movement paths of said deflection rollers and said auxiliary rollers.

7. Stretching arrangement in accordance with claim 1, wherein movement paths of the deflection rollers and the auxiliary rollers are concentric circular paths.

8. Stretching arrangement in accordance with claim 7 comprising a deflection roller ring in which the deflection rollers are affixed and an auxiliary roller ring in which the auxiliary rollers are mounted, said deflection roller ring being located internally of the auxiliary roller ring, both rings having the same midpoint.

9. Stretching arrangement in accordance with claim 8, wherein the deflection roller ring and the auxiliary roller ring each are provided with drive means whereby they are rotatably driveable in mutually opposed directions of rotation.

10. Stretching arrangement in accordance with claim 9, wherein at least one of the said drive means is provided as a pneumatic or hydraulic piston cylinder unit.

11. Stretching arrangement in accordance with claim 9, wherein said drive means for said auxiliary roller is provided as a single pneumatic or hydraulic piston cylinder unit.

12. Stretching arrangement in accordance with claim 10, wherein a maximum force applyable by the auxiliary ring to the threads is arranged to be less than the stretching force on the threads.

13. Stretching arrangement in accordance with claim 10, wherein pressure in the piston cylinder arrangement is adjustable to vary over the movement path of the piston.

14. Stretching arrangement in accordance with claim 11, wherein a maximum force applyable by the auxiliary ring to the threads is arranged to be less than the stretching force on the threads.

15. Stretching arrangement in accordance with claim 11, wherein pressure in the piston cylinder arrangement is adjustable to vary over the movement path of the piston.

* * * * *